US008702483B2

(12) United States Patent
Weng et al.

(10) Patent No.: US 8,702,483 B2
(45) Date of Patent: Apr. 22, 2014

(54) ASSEMBLY OF PIPE UNIT AND PIPE HOOD FOR VENTILATING FAN

(75) Inventors: Yefan Weng, Guangdong (CN); Guanxian Liang, Guangdong (CN); Yu Feng, Guangdong (CN)

(73) Assignees: Panasonic Ecology Systems Guangdong Co., Ltd., Guangdong (CN); Panasonic Corporation, Osaka (JP)

( * ) Notice: Subject to any disclaimer, the term of this patent is extended or adjusted under 35 U.S.C. 154(b) by 778 days.

(21) Appl. No.: 12/552,693

(22) Filed: Sep. 2, 2009

(65) Prior Publication Data

US 2010/0081370 A1 Apr. 1, 2010

(30) Foreign Application Priority Data

Sep. 26, 2008 (CN) ..... 2008 1 0168950

(51) Int. Cl.
*E05G 1/00* (2006.01)

(52) U.S. Cl.
USPC ..... 454/243; 454/237

(58) Field of Classification Search
USPC ..... 55/385.3; 454/8, 367, 275, 241–249, 454/237, 251; 403/364, 330; 292/256, 262, 292/300, 302–304; 220/3.8, 4.02, 4.21, 220/4.22, 4.24
See application file for complete search history.

(56) References Cited

U.S. PATENT DOCUMENTS 1,529,711 A * 3/1925 Parrott et al. ..... 454/243
2,550,353 A * 4/1951 Hopfinger ..... 454/136
3,279,349 A * 10/1966 Landau ..... 454/241
4,111,004 A * 9/1978 Blomberg ..... 62/476
4,186,541 A * 2/1980 Sivachenko ..... 52/630
4,316,363 A * 2/1982 McKirdy ..... 62/89
4,744,409 A * 5/1988 Berner ..... 165/4
4,785,596 A * 11/1988 Wiley et al. ..... 52/198
5,842,499 A * 12/1998 Hall ..... 137/360
6,102,030 A * 8/2000 Brown et al. ..... 126/85 B (Continued)

FOREIGN PATENT DOCUMENTS

AU 2004100558 A4 * 9/2004
JP 59100330 A * 6/1984

*Primary Examiner* — Steven B McAllister
*Assistant Examiner* — Jamil Decker
(74) *Attorney, Agent, or Firm* — RatnerPrestia

(57) ABSTRACT

An assembly of pipe hood and pipe unit for a ventilating fan, comprising a front cover, a rear cover and a pipe unit, characterized in that: a baffle is vertically provided in the pipe unit to divide the pipe into an air inlet pipe and an air outlet pipe on the left and right sides respectively; a partition plate is vertically provided in the rear cover corresponding to the baffle to divide the space enclosed by the front cover and the rear cover into an air inlet side and an air outlet side on the left and right sides respectively; an external air inlet opening and an external air outlet opening are provided on the outer side of the rear cover on the left and right sides respectively; an internal air inlet opening and an internal air outlet opening are provided on the inner side of the rear cover on the left and right sides respectively; an air inlet passage and an air outlet passage are formed in parallel to each other on the left and right sides respectively. Since the inflow air and the outflow air flow to the left and right sides respectively, the contaminated air discharged from the pipe unit can be prevented from mixing with the fresh air entering the room, and the ventilating effect can be ensured.

18 Claims, 10 Drawing Sheets

(56) References Cited

U.S. PATENT DOCUMENTS 6,193,089 B1 * 2/2001 Yu ..... 220/4.21
6,196,469 B1 * 3/2001 Pearson ..... 236/49.3
6,776,704 B2 * 8/2004 Goncalves et al. ..... 454/8
2004/0076524 A1 * 4/2004 Hanson ..... 417/38
2008/0223566 A1 * 9/2008 Higashiyama et al. ..... 165/176

* cited by examiner

ASSEMBLY OF PIPE UNIT AND PIPE HOOD FOR VENTILATING FAN

RELATED APPLICATIONS

This application claims priority under 35 U.S.C. §119 to Chinese Patent Application No. 200810168950.X, filed Sep. 26, 2008, the contents of which are incorporated by reference herein for all purposes.

FIELD OF THE INVENTION

The present invention relates to an assembly of pipe hood and pipe unit for a ventilating fan, and more particularly, to an assembly of pipe hood and pipe unit for introducing air and discharging air in a ventilating fan.

BACKGROUND OF THE INVENTION

FIG. 1 shows a common assembly of pipe hood and pipe unit at the air inlet and outlet openings in a ventilating fan. FIG. 2 is a schematic view of FIG. 1 showing the internal construction thereof. As shown in FIG. 1, the pipe hood 10 is made of a front cover 11 and a rear cover 12. A horizontal baffle 21 is provided inside the pipe unit 20 to form an upper air outlet pipe and a lower air inlet pipe 22. Corresponding to the baffle 21, the rear cover 12 is also provided with a horizontal partition plate 120 to divide the space enclosed by the front cover 11 and the rear cover 12 into an upper air outlet side 112 and a lower air inlet side 113 and form an internal air outlet opening 130 and an internal air inlet opening 140. An external air outlet opening 115 is formed on the upper portion of the front side of the front cover 11, and an external air inlet opening 114 is formed under the front side of the front cover. When the ventilating fan is in use, the air discharged from the ventilating fan enters the air outlet side 112 via the air outlet pipe 23 and the internal air outlet opening 130, and then is discharged to the outdoor via the external air outlet opening 115. Simultaneously, the fresh air introduced by the external air inlet opening 114 from the outdoor enters the air inlet side 113, the internal air inlet opening 140 and arrives at the inside of the ventilating fan via the air inlet pipe 22. Therefore, an air outlet passage and an air inlet passage are formed vertically on the upper side and the lower side in a vertical direction as shown in FIG. 2, respectively.

However, because the external air outlet opening 115 and the external air inlet opening 114 are disposed on the upper and lower sides of the front side of the pipe hood 10 respectively, when the air is blown from the front side or from the upper side, the air discharged from the external air outlet opening 115 may enter into the indoor room via the external air inlet opening 114 and cause a secondary contamination of the air to be fed into inside of the room.

Further, because the external air outlet opening 115 is positioned on the front side of the pipe hood 10 and the switching curtains at the external air inlet opening 114 and external air outlet opening 115 maintain a fixed structure in use, the rain, foreign object and the like are likely to enter into the pipe hood 10 via the external air inlet opening 114 and the external air outlet opening 115 and thus enter into the ventilating fan and entails greater potential safety trouble.

Further, because the inside of the pipe hood 10 needs to be cleaned regularly, the front cover 11 needs to be disassembled frequently. However, there is no satisfactory snapping structure between the front cover 11 and the rear cover 12.

Further, such a conventional design does not takes into account of the fact that the temperature of the discharged air is usually higher than the introduced air, and therefore, there is no heat exchange in the whole structure and thus the energy is wasted.

SUMMARY OF THE INVENTION

A main object of the present invention is to provide an assembly of pipe hood and pipe unit for a ventilating fan, which can effectively prevent the discharged air from entering into the air inlet opening again.

Another object of the present invention is to provide an assembly of pipe hood and pipe unit for a ventilating fan, which can effectively alleviate the problem of the rain and the foreign material entering the pipe unit from the front side and facilitate the discharge of the rain and the foreign object and increase the safety performance of the ventilating fan.

A further object of the present invention is to provide an assembly of pipe hood and pipe unit for a ventilating fan, which allows easy assembly and disassembly of the pipe hood and facilitates the cleaning work and increases the service life of the product.

A still further object of the present invention is to provide an assembly of pipe hood and pipe unit for a ventilating fan, which can fully take advantage of the discharged air to heat the introduced air so as to enhance energy efficiency.

In order to achieve at least one of the above objects, the present invention provides an assembly of pipe hood and pipe unit for a ventilating fan comprising a front cover, a rear cover and a pipe unit, characterized in that: a baffle is vertically provided in the pipe unit to divide the pipe into an air inlet pipe and an air outlet pipe on the left and right sides respectively; a partition plate is vertically provided in the rear cover corresponding to the baffle to divide the space enclosed by the front cover and the rear cover into an air inlet side and an air outlet side on the left and right sides respectively; an external air inlet opening and an external air outlet opening are provided on the outer side of the rear cover on the left and right sides respectively; an internal air inlet opening and an internal air outlet opening are provided on the inner side of the rear cover on the left and right sides respectively; an air inlet passage and an air outlet passage are formed in parallel to each other on the left and right sides respectively.

The front side of the front cover is slanted or curved.

The internal air inlet opening is provided with an extended wall enclosed by the partition plate.

The partition plate is made of material of good thermal conductance. Therefore, the heat exchange effect is improved and the air on the air outlet side can heat the air on the air inlet side much better.

The partition plate is made of material of good thermal conductance.

The partition plate is provided with concave and convex configurations.

The concave and convex configurations comprise convexes projected from the air outlet side to the air inlet side on a portion of the partition plate opposite to the extended wall and concaves recessed from the air inlet side to the air outlet side on the remaining portions of the partition plate.

A receiving groove is provided longitudinally on the inner side of the front cover for receiving the partition plate; the opening portion of the receiving groove is shaped in a "V" shape.

Guide blocks are provided at two sides of the receiving groove.

The rear cover is provided with an elastic claw on the upper side of the rear cover; the front cover is provided with a projected piece engaging with the claw on the upper side of the front cover; the rear cover is further provided with a first projection having a stepped configuration or having slanting sides on the lower side of the rear cover; the front cover is provided with a projected block adapted to cooperate and engage with the first projection on the lower side of the front cover; and the first projection and the projected block are formed with bores or holes.

The projected block of the front cover is projected toward the inner side of the front cover, and the portion on the outer side of the front cover is concavely disposed.

The first projection of the rear cover is formed to have a hollow portion, the middle portion of the first projection is projected over the upper portion and the lower portion so as to form a stepped configuration.

A slanting configuration for slanting the pipe unit toward the outdoor is provided at the connection portion between the rear cover and the pipe unit.

The slanting configuration is a second projection located at the lower end of the rear cover.

The slanting configuration is a third projection located at the lower end of the pipe unit.

The external air inlet opening and the external air outlet opening are provided with a grating formed of a plurality of bars parallel with each other and slanting downward toward the outdoor.

A mesh having apertures smaller than the apertures of the grating is provided on the inner side of the grating.

The grating and the mesh are integratedly formed with the rear cover.

A water drain outlet is provided below the grating, and the middle portion of the bottom of the rear cover is higher than the two side portions and is slanted toward the water drain outlet.

The height of the water drain outlet is less than the distance between the bars of the grating.

The advantage of the present invention lies in that since the inflow air and the outflow air flow to the left and right sides respectively, the contaminated air discharged can be prevented from mixing with the fresh air entering the room, and a good ventilating effect can be ensured.

DETAILED DESCRIPTION OF THE PREFERRED EMBODIMENTS

Figure 1:
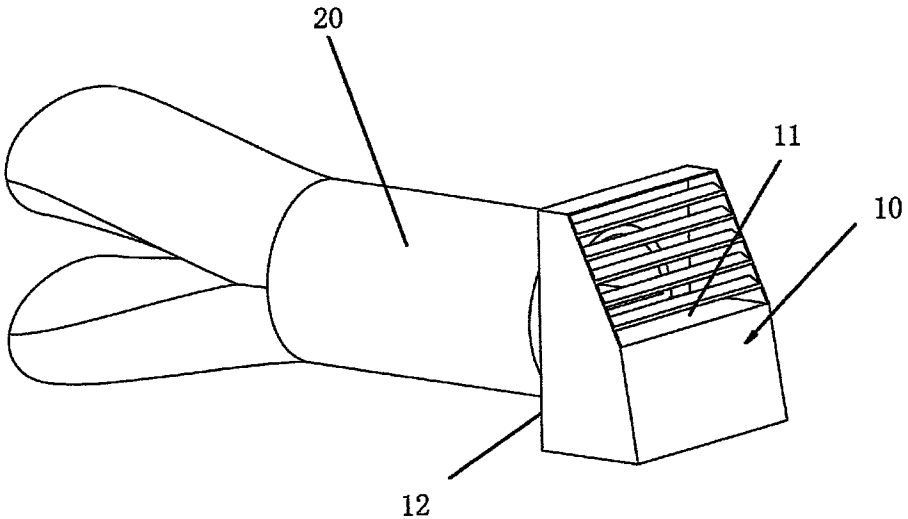
Fig. 1 PRIOR ART
FIG. 1 is a perspective view of the prior art.
Figure 2:
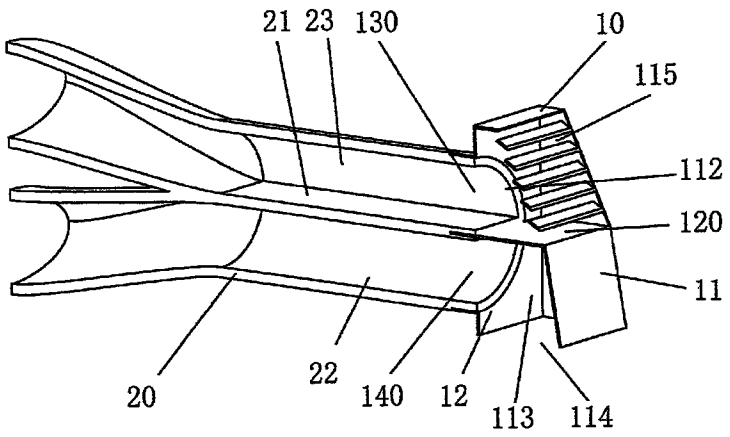
Fig. 2 PRIOR ART
FIG. 2 is a schematic view of FIG. 1 with a part of the assembly in FIG. 1 cut away.
Figure 3:
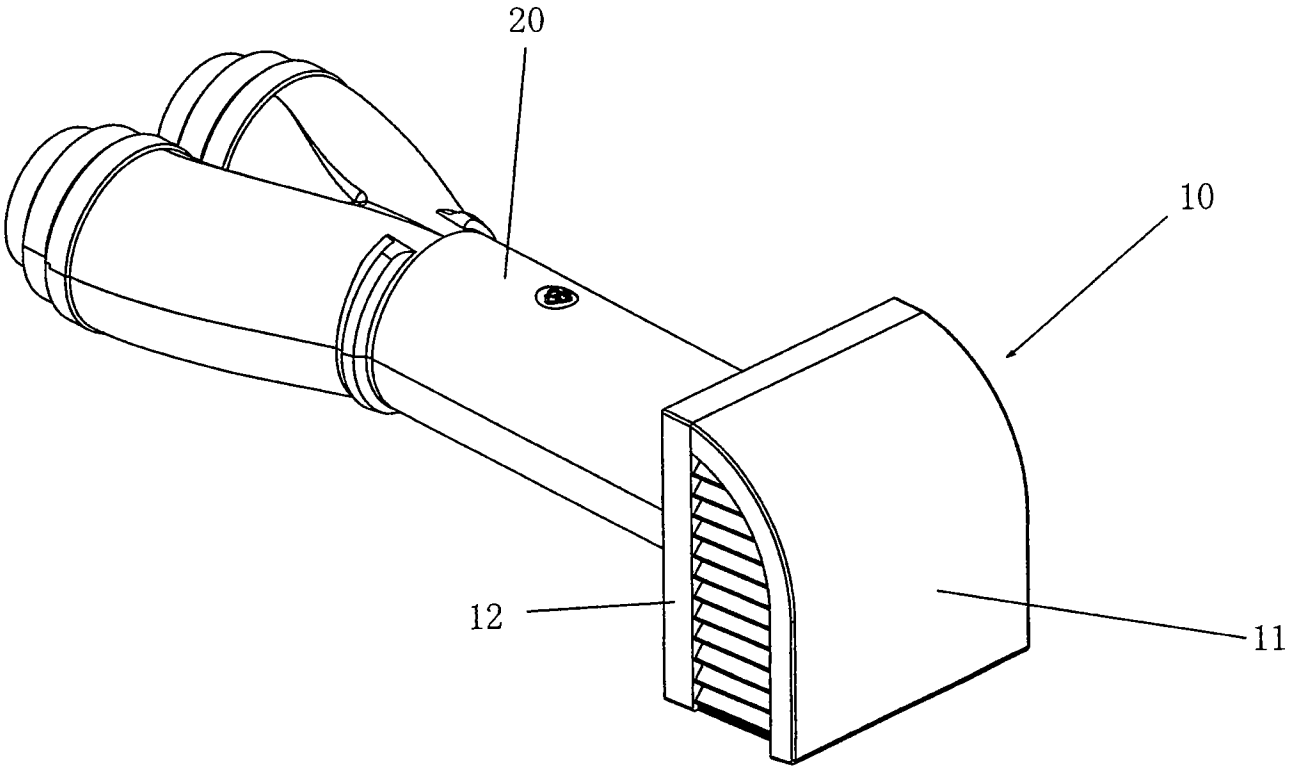
FIG. 3 is a general schematic view of the embodiment of the present invention.
Figure 4:
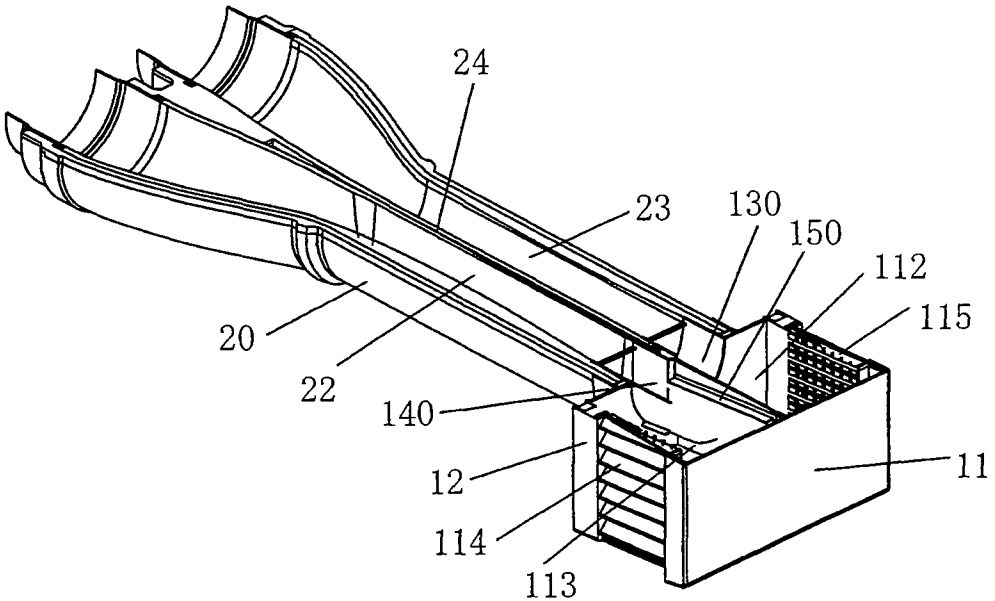
FIG. 4 is a general schematic view of the embodiment of the present invention with a part of the assembly in FIG. 3 cut away.

The present invention will be described in detail with reference to the embodiments. The examples thereof are shown in the figures. Throughout the drawings, the same reference numerals designate the same elements or parts. The embodiment is described in conjunction with the drawings in order to explain the present invention FIGS. 3 and 4 are general schematic view of an embodiment the present invention. FIG. 9 is a schematic view of a pipe unit of an embodiment of the present invention. FIG. 3 and FIG. 4 show an assembly of pipe hood and a pipe unit. The assembly of a pipe hood and a pipe unit comprises a front cover 11, a rear cover 12 and a pipe unit 20. The front cover 11 is a slanting closed surface. The pipe unit 20 is provided therein with a vertical baffle 24 to divide the pipe unit 20 into an air inlet pipe 22 on the left side and an air outlet pipe 23 on the right side. Corresponding to the baffle 24, the rear cover 12 is provided with a vertical partition plate 150 to divide the space enclosed by the front cover 11 and the rear cover 12 into an air inlet side 113 on the left side and an air outlet side 112 on the right side. The rear cover 12 is provided on the outer side thereof with an external air outlet opening 115 on the right side and an external air inlet opening 114 on the left side. The rear cover 12 is provided on the inner side thereof with an internal air outlet opening 130 on the right side and an internal air inlet opening 140 on the left side. With the above configuration, an air inlet passage and an air outlet passage are formed in parallel to each other on the left and right sides respectively.

Since the inflow air and the outflow air flow to the left and right sides respectively, the contaminated air discharged can be prevented from mixing with the fresh air entering into the room, and the good ventilating effect can be ensured. In addition, because the front side of the front cover 11 is closed, the rain, the snow and the other foreign material can be prevented from accumulating on the front cover 11 and entering the external air inlet opening 114 and a good appearance can be obtained. The front cover 11 and the rear cover 12 may also combine to form other curved surfaces such as a hemispheric shape.

The partition plate 150 and the baffle 24 in the pipe unit 20 may be made of material of good thermal conductance. Therefore, the heat exchange effect can be improved and the air in the air outlet side 112 and in the air outlet pipe 23 can heat the air in the air inlet side 113 and in the air inlet pipe 22 much better.

Figure 5:
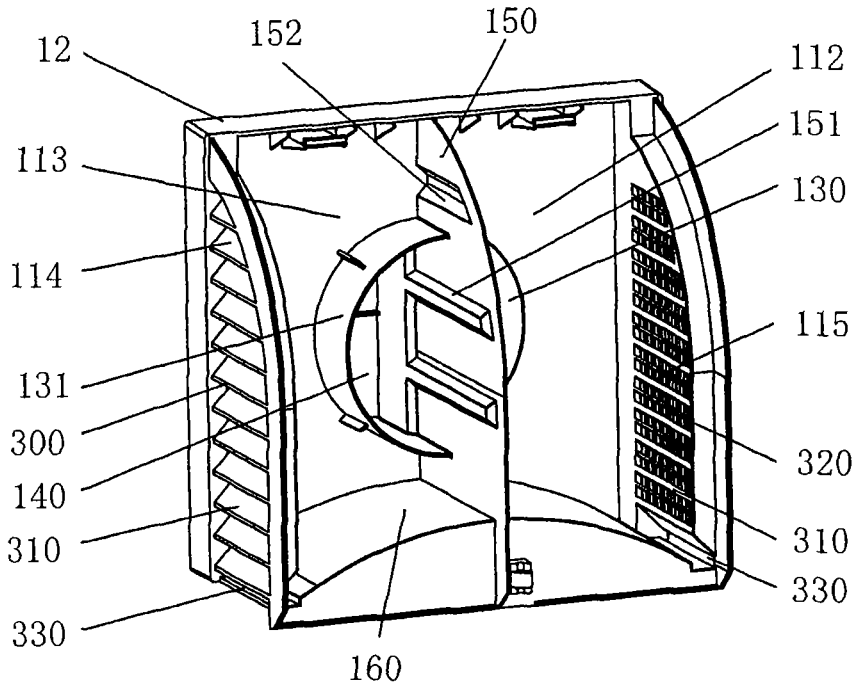
FIG. 5 is a schematic view of the rear cover according to the embodiment of the present invention.

FIG. 5 is a schematic view of the rear cover 12 of an embodiment of the present invention. As shown in FIG. 5, the internal air inlet opening 140 is provided with an extended wall 131 whose two ends are enclosed by the partition plate 150. The extended wall 131 acts to prevent the foreign material from flowing or entering into the pipe. Due to the presence of the extended wall 131, the air entering the air inlet side 113 will form a turbulent flow at the extended wall 131. Because the foreign material absorbed by the air is relatively heavy, it will naturally fall down on the bottom 160 of the rear cover 12. Therefore, the foreign material is removed. Further, if insects and the like accidentally enter into the air inlet side 113, due to blocking of the extended wall 131, they are not likely to enter into the inner air inlet pipe 22 (not shown in FIG. 5) via the internal air inlet opening 140.

Referring to FIG. 5 again, the partition plate 150 is provided with concave and convex configurations. On a portion of the partition plate 150 opposite to the extended wall 131, convexes 151 are provided in such a manner that they project toward the extended wall 131, and on the remaining portions of the partition plate 150, concaves 152 are provided in such a manner that they recess away from the extended wall 131. That is to say, the convexes 151 are projected from the partition plate 150 to the air inlet side 113, and the concaves 152 is recessed from the partition plate 150 away from the air inlet side 113. In other words, the convexes 151 are recessed away from the air outlet side 112 and the concaves 152 are projected toward the air outlet side 112. In comparison with the situation in which the convexes 151 are disposed on the air outlet side 112, when the convexes 151 are disposed to project toward the air inlet side 113, the convexes 151 impede the inflow air much less. As a matter of the presence of the air blower, the convexes 151 affect the air inlet side 113 absorbing air less than the air outlet side 112 discharging air. Further, due to the convex and concave configurations, the strength of the partition plate 150 can be increased. The resin partition plate 150 with an increased strength is easier to be shaped. The convex and concave configurations also increase the heat exchange area between the inflow air and the outflow air.

Referring to FIG. 5 again, the external air inlet opening 114 and the external air outlet opening 115 are integrally formed with a grating 300 and a mesh 320. The grating 300 are formed of a plurality of bars 310 parallel with each other and slanting downward toward the outdoor. With this configuration, the air is allowed to smoothly flow in and out of the pipe hood along the slanting bars; at the same time, the rain and the foreign material can be prevented from entering into the pipe hood. The mesh 320 is disposed on an inner side of the grating 300 and has apertures smaller than the apertures of the grating 300. For example, if the distance between two bars 310 is 15 mm, then the aperture of the grating 300 is 15 mm. the aperture of the mesh 320 may be 7 mm. The integrally formed configuration can avoid the grating 300 and mesh 320 being left out during the installation. At the same time, the cost for the molds can be reduced due to the simplified configuration.

Further, a water drain outlet 330 is provided below the grating 300. The height of the water drain outlet 330 is less than the distance between the bars 310 of the grating 300. Because the water drain outlet 330 has a small area, the rain and the other foreign material are not likely to come into the pipe hood. In addition, the shape of the bottom 160 of the rear cover 12 is designed such that the middle portion is higher than the two side portions and is slanted toward the water drain outlet 330. In this way, even if the rain and the other foreign material come into the pipe hood, they are likely to be discharged toward the water drain outlet 330 by the slanting bottom 160 of the rear cover 12. Because there is no mesh structure at the water drain outlet 330, the rain and the other foreign material can flow out smoothly without being caught by the mesh structure. Therefore, the pipe hood can be kept clean and dry so that a better ventilating effect can be obtained.

Figure 6:
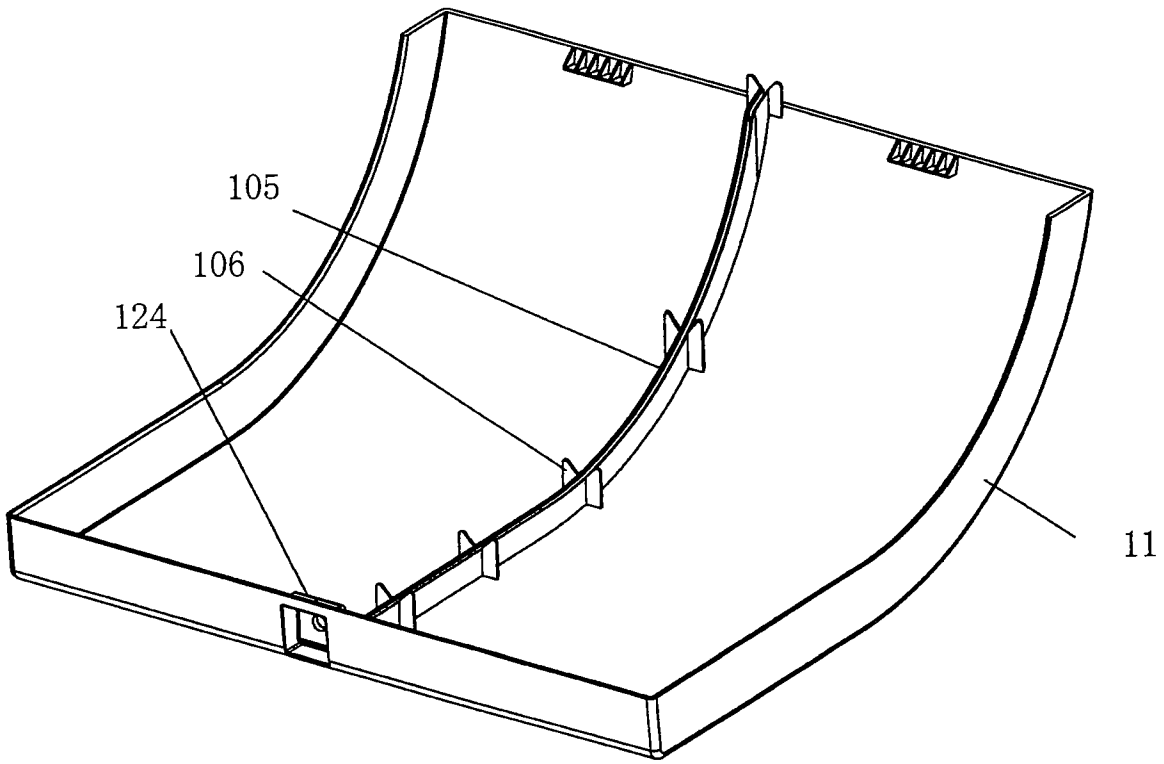
FIG. 6 is a schematic view showing an inner side of the front cover of the embodiment of the present invention.

FIG. 6 is a schematic view showing the inner side of the front cover 11. As shown in FIG. 6, in order to improve the assembly performance between the front cover 11 and the rear cover 12 (not shown in FIG. 6), a receiving groove 105 is provided longitudinally on the inner side of the front cover 11 for receiving the partition plate 150 (not shown in FIG. 6). Guide blocks 106 are provided at two sides of the receiving groove 105. The opening portion of the receiving groove 105 is shaped in a "V" shape. That is, the opening portion of the receiving groove 105 is flared outwardly to guide the partition plate 150 (not shown in FIG. 6) to enter into the inside of the receiving groove 105. The guide blocks 106 is positioned on the inner side of the front cover 11 for guiding the partition plate 150 (not shown in FIG. 6) from a position away from the configuration of "V" shape to a designated position, i.e., the receiving groove 105. When it is needed to put the front cover 11 on the rear cover 12 (not shown in FIG. 6), the guide blocks 106 are aligned with the partition plate (not shown in FIG. 6), and then the front cover 11 is pushed forward. In this way, the partition plate 150 (not shown in FIG. 6) can slide in the receiving groove 105 smoothly along the configuration of the "V" shape and thus the front cover 11 can be received in the rear cover 12 (not shown in FIG. 6). In this way, the front cover 11 can be simply engaged with the rear cover 12 (not shown in FIG. 6) and installation of the air inlet and outlet pipe hood is improved and the sealing performance is also improved.

Figure 7:
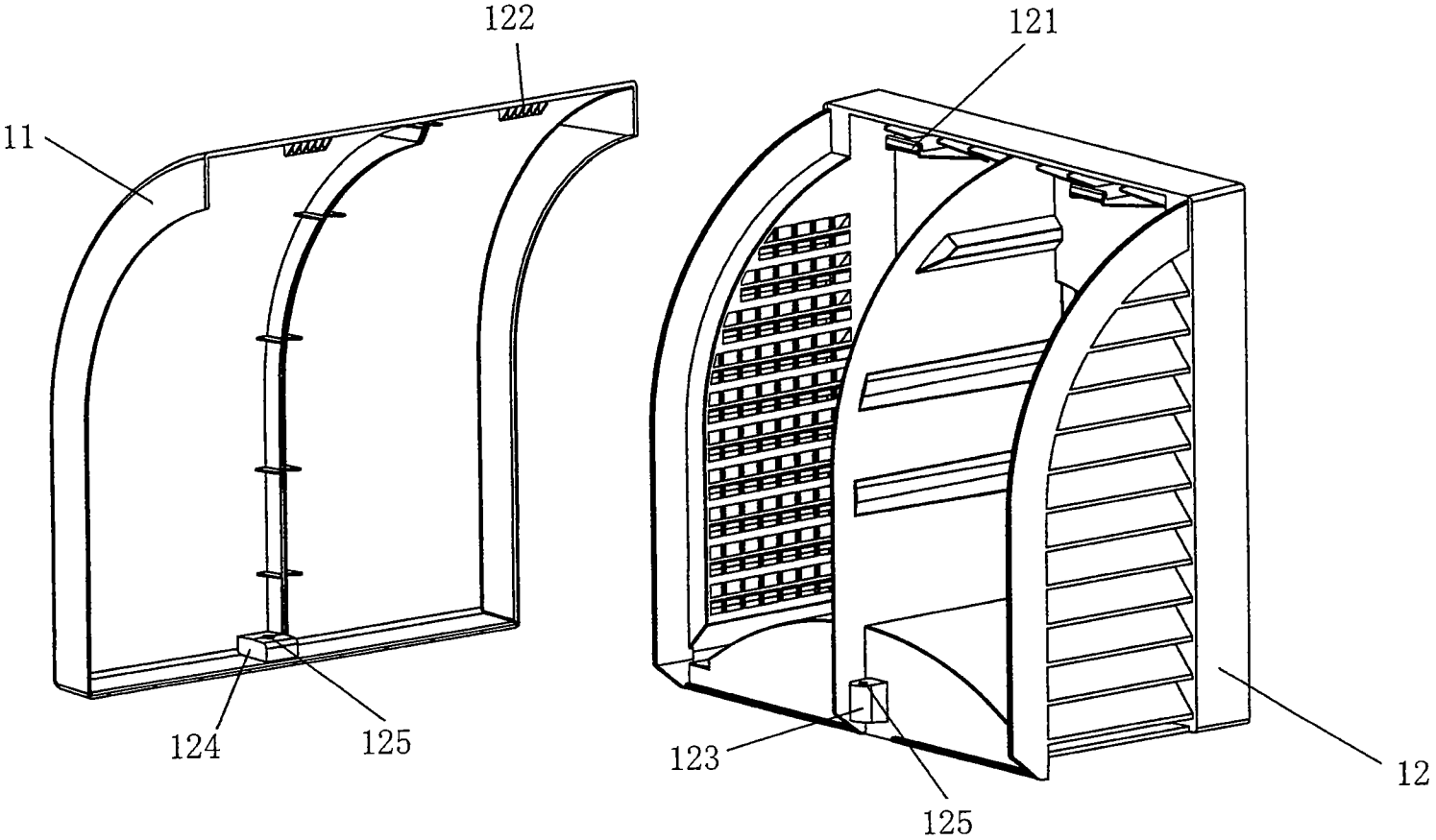
FIG. 7 is a schematic view of a first embodiment of the present invention of the engagement configuration between the front cover and the rear cover.

FIG. 7 is a schematic view of a first embodiment of the engagement between the front cover 11 and rear cover 12. As shown in the figures, the rear cover 12 is provided with elastic claws 121 on the upper side thereof and a first projection 123 with a bevel face on the lower side thereof. The front cover 11 is provided with projected pieces 122 engaging with the claws 121 on the upper side thereof and a projected block 124 adapted to cooperate with the projection 123 on the lower side thereof. The projection 123 and the projected block 124 are formed with holes or bores 125. When the front cover 11 is installed, it can slide into the rear cover 12 from the front side. On the upper portions of the front cover 11 and the rear cover 12, when the projected pieces 122 meet the claws 121, the upper portions of the front cover 11 and the rear cover 12 are snapped with each other by the elasticity of the claws 121. At the same time, the lower portion of the front cover 11 is pushed to make the projection 123 and the projected block 124 on the lower portions of the front cover 11 and the rear cover 12 to cooperate with each other. Then a screw (not shown) is passed through the bores 125 formed in the projected block 124 on the front cover 11 and the projection 123 on the rear cover 12 so that they are brought to be fastened together. In this way, the front cover 11 and the rear cover 12 are engaged with each other.

Referring to FIG. 6 again, the projected block 124 of the front cover 11 is projected toward the inner side of the front cover 11, and the portion on the outer side of the front cover 11 is concavely disposed as shown in FIG. 6. When the projected block 124 and the projection 123 are fastened together by passing the screw through the front cover 11 and the rear cover 12, the head of the screw is depressed in the concavely disposed projected block 124 so that the head of the screw does not project out of the front cover 11 and the pipe hood has a good appearance.

When the inside of the pipe hood is cleaned, the screw is removed and the lower portion of the front cover 11 is raised up to rotate toward the engaging portion of the claws 121 and the projected pieces 122 so as to release the assembly of the projection 123 and the projected block 124. After that, by detaching the engagement of the claws 121 and the projected pieces 122, the front cover 11 can be removed easily. In this way, the front cover 11 is easy to be attached and detached and the assembly performance of the air inlet and outlet pipe hood is improved.

Figure 8:
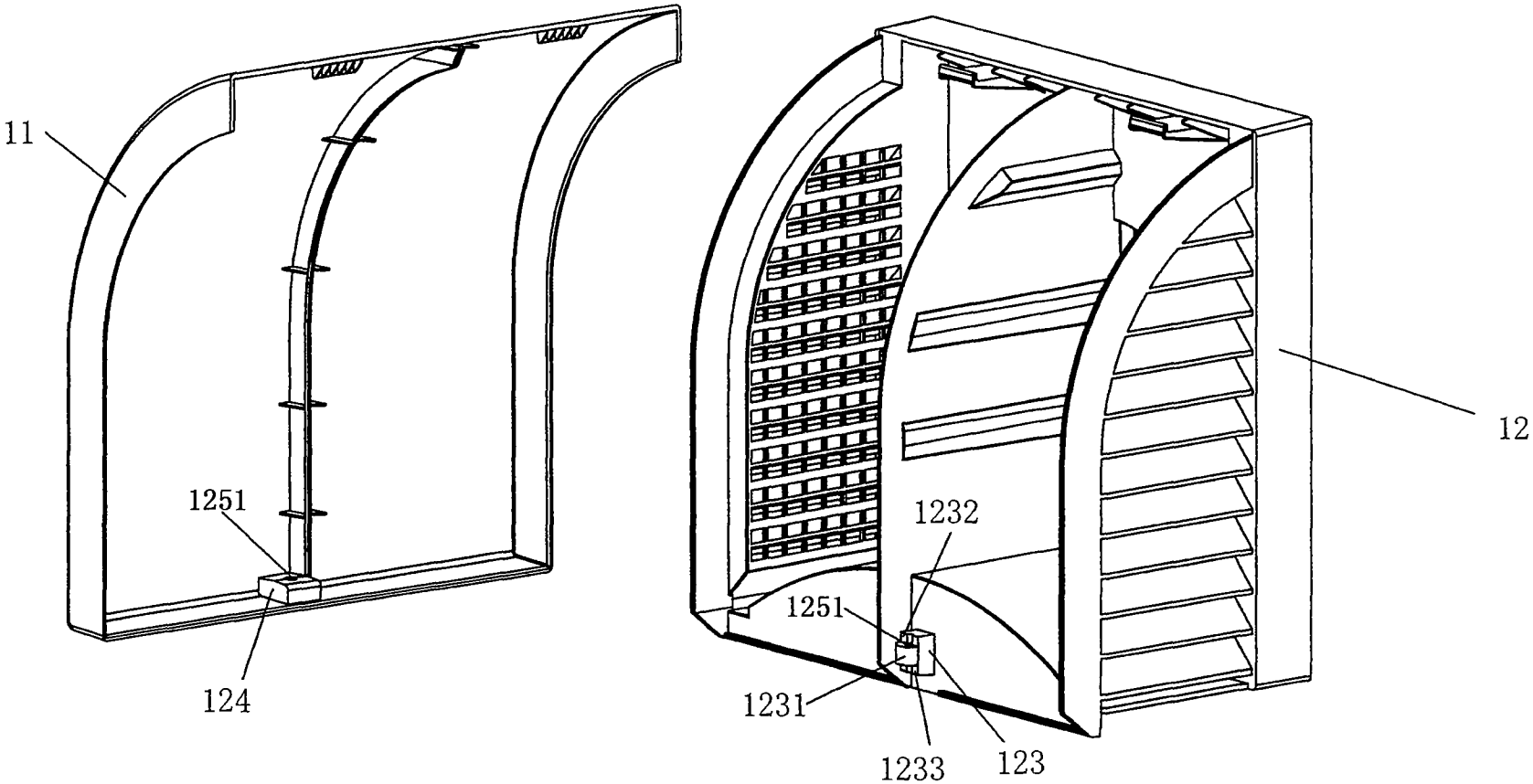
FIG. 8 is a schematic view of a second embodiment of the present invention of the engagement configuration between the front cover and the rear cover.

FIG. 8 is schematic view showing a second embodiment of the engagement between the front cover 11 and the rear cover 12. The second embodiment of the engagement between the front cover 11 and the rear cover 12 differs from the first embodiment in that the first projection 123 of the rear cover 12 is formed to have a hollow portion and that a middle portion 1231 of the projection 123 is projected over an upper portion 1232 and a lower portion 1233 so as to form a stepped configuration. By providing the stepped configuration and the hollowed structure, even if the direction of holes 1251 along which the screw passes is perpendicular to the projecting direction of the projection 123, the holes 1251 can be simply formed. The so-called "simply formed" means that although the projecting direction of the projection 123 is different from the direction of the holes 1251 for the screw, when the resin is modeled, even if a slipform is not used, the screw holes, bores or hollows can be formed in one step when demoulding operation is performed in the projecting direction.

Figure 9A:
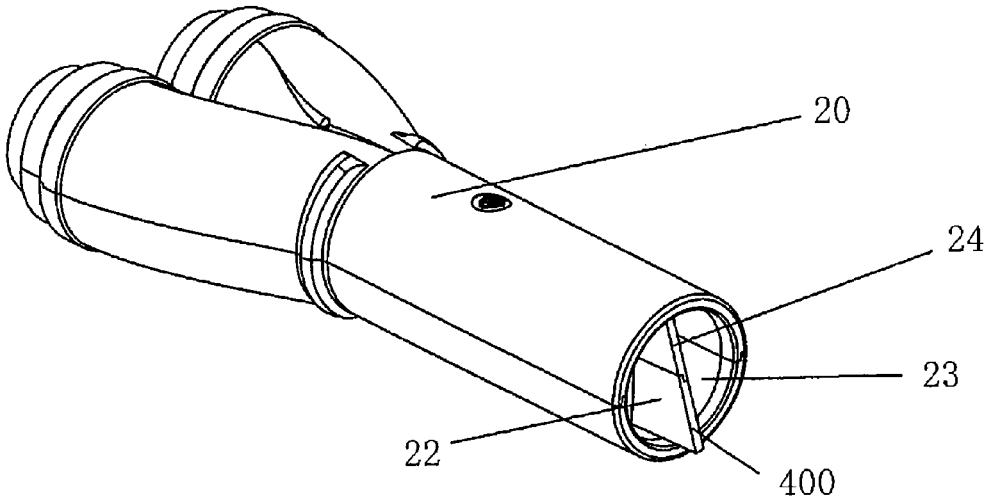
FIGS. 9A and 9B are schematic views of the pipe unit according to the embodiment of the present invention.
Figure 9B:
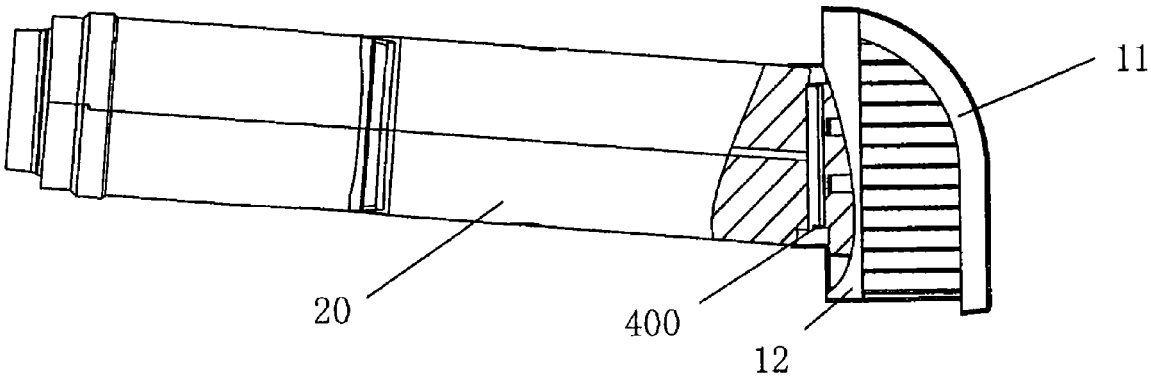

FIGS. 9A and 9B are schematic view of the pipe according to the embodiment of the present invention. The baffle 24 on a side of the pipe unit 20 has its lower portion projected out of the pipe unit 20 compared with the upper portion thereof so that a slanting block 400 as a second projection is formed between the upper portion and the lower portion of the baffle 24. When the rear cover 12 is fitted to the pipe unit 20, the rear cover 12 contacts the slanting block 400 and the pipe naturally tilts towards the outdoor. Therefore, even if no slanting configuration for slanting the pipe unit 20 toward the rear cover 12 is provided, the pipe unit 20 can naturally slant with respect to the rear cover 12 upon connection with the rear cover 12.

Figure 10A:
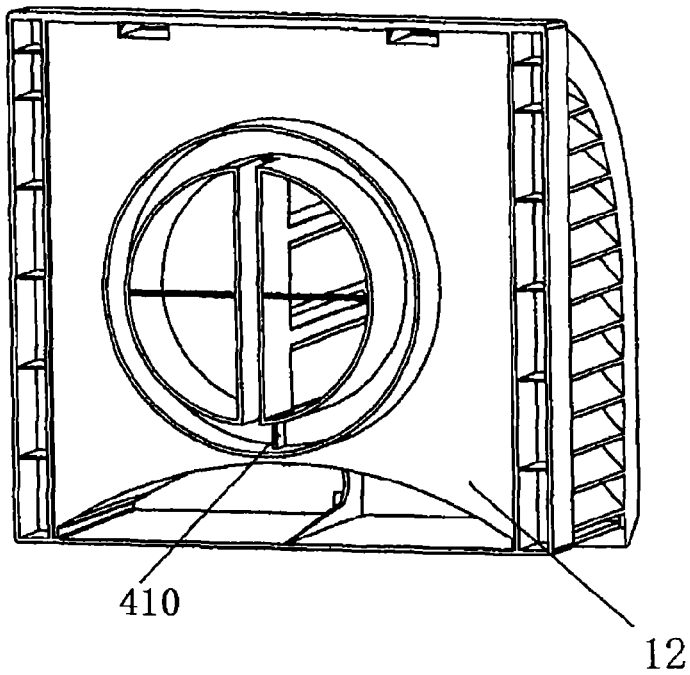
FIGS. 10A and 10B are schematic views of the second embodiment of the slanting blocks according to the present invention.
Figure 10B:
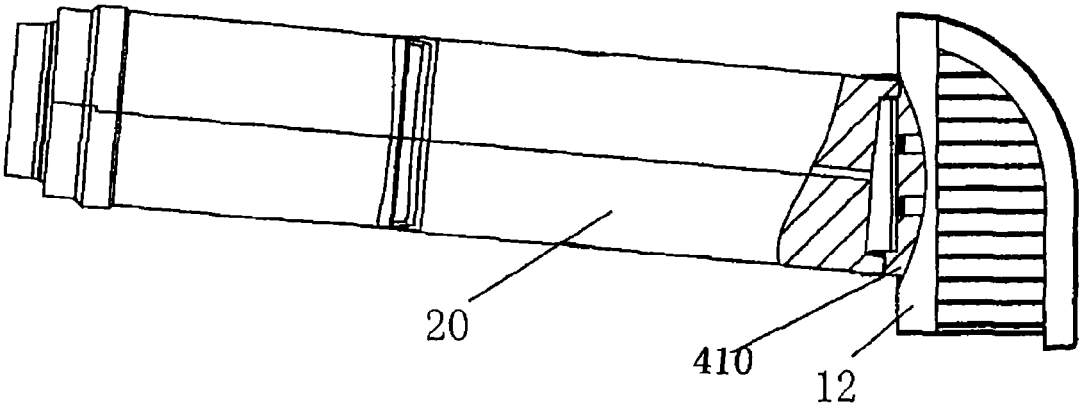

Further, as another embodiment of the slanting configuration, a slanting block 410 as a third projection may be mounted on the lower end of the rear cover 12, as shown in FIGS. 10A and 10B. FIGS. 10A and 10B are schematic views of the back side of the rear cover 12. As shown in FIGS. 10A and 10B, by providing the slanting block 410 on the rear cover 12 for contacting the lower portion of the pipe unit 20, the pipe unit 20 can also be slanted toward the outdoor in the same way after the rear cover 12 is assembled with the pipe unit 20. Further, because the pipe unit naturally slants toward the outdoor, even if the rain and the other foreign material come into the pipe unit 20, they will flow out of the pipe unit quickly along the slanting pipe unit 20. Therefore, the pipe unit 20 can be kept clean, dry and unblocked and the ventilating effect is good.

Although the embodiments of the present invention have been described and illustrated above, it will be appreciated by those skilled in the art that the embodiments can be further modified and changed in various ways without departing from the scope of the claims.

What is claimed is:

1. An assembly of pipe hood and pipe unit for a ventilating fan, comprising;

a front cover, a rear cover;

a pipe unit;

a baffle vertically provided in the pipe unit to divide the pipe unit into an air inlet pipe and an air outlet pipe on left and right sides respectively;

a partition plate vertically provided in the rear cover corresponding to the baffle to divide the space enclosed by the front cover and the rear cover into an air inlet side and an air outlet side on the left and right sides respectively;

an external air inlet opening and an external air outlet opening provided on an outer side of the rear cover on the left and right sides respectively;

an internal air inlet opening and an internal air outlet opening provided on an inner side of the rear cover on the left and right sides respectively; and an air inlet passage and an air outlet passage formed in parallel to each other on the left and right sides respectively, wherein the internal air inlet opening is provided with an extended wall adjacent to the partition plate, the extended wall spanning a portion of the partition plate, the partition plate is provided with raised portions that are raised toward the air inlet side on an air inlet side of said portion of the partition plate spanned by the extended wall, and there is no raised portion raised toward the air outlet side on an air outlet side of said portion of the partition plate spanned by the extended wall, and the partition plate is provided with at least one raised portion that is raised toward the air outlet side on an air outlet side of a remaining portion of the partition plate not spanned by the extended wall.

2. The assembly of pipe hood and pipe unit for a ventilating fan according to claim 1, wherein the front side of the front cover is slanted or curved.

3. The assembly of pipe hood and pipe unit for a ventilating fan according to claim 1, wherein the partition plate is made of a material supplying thermal conductance.

4. The assembly of pipe hood and pipe unit for a ventilating fan according to claim 1, wherein the baffle in the pipe unit is made of a material supplying thermal conductance.

5. The assembly of pipe hood and pipe unit for a ventilating fan according to claim 1, wherein a receiving groove is provided longitudinally on the inner side of the front cover for receiving the partition plate; the opening portion of the receiving groove is "V" shaped.

6. The assembly of pipe hood and pipe unit for a ventilating fan according to claim 5, wherein guide blocks are provided at two sides of the receiving groove.

7. The assembly of pipe hood and pipe unit for a ventilating fan according to claim 1, wherein an elastic claw is provided on the upper side of the rear cover; a projected piece engaging the elastic claw is provided on the upper side of the front cover; a first projection is provided on the lower side of the rear cover; a projected block is provided on the lower side of the front cover, which is adapted to cooperate with the first projection on the lower side of the rear cover; and the first projection and the projected block are formed with bores or holes.

8. The assembly of pipe hood and pipe unit for a ventilating fan according to claim 7, wherein the projected block of the front cover is projected to the space enclosed by the front cover and the rear cover, and a portion of the projected block located on the outer side of the front cover is concavely disposed.

9. The assembly of pipe hood and pipe unit for a ventilating fan according to claim 7, wherein the first projection of the rear cover is formed to have a hollow portion, the middle portion of the first projection is projected over the upper portion and the lower portion of the first projection.

10. The assembly of pipe hood and pipe unit for a ventilating fan according to claim 1, wherein a slanting configuration for slanting the pipe unit toward the outdoor is provided at the connection portion between the rear cover and the pipe unit.

11. The assembly of pipe hood and pipe unit for a ventilating fan according to claim 10, wherein the slanting configuration is a second projection located at the lower end of the rear cover.

12. The assembly of pipe hood and pipe unit for a ventilating fan according to claim 10, wherein the slanting configuration is a third projection located at the lower end of the pipe unit.

13. The assembly of pipe hood and pipe unit for a ventilating fan according to claim 1, wherein the external air inlet opening and the external air outlet opening are provided with a grating formed of a plurality of bars parallel with each other and slanting downward toward the outdoor.

14. The assembly of pipe hood and pipe unit for a ventilating fan according to claim 13, wherein a mesh having apertures smaller than the apertures of the grating is provided on an inner side of the grating.

15. The assembly of pipe hood and pipe unit for a ventilating fan according to claim 14, wherein the grating and the mesh are integrally formed with the rear cover.

16. The assembly of pipe hood and pipe unit for a ventilating fan according to claim 13, wherein a water drain outlet is provided below the grating, and an intermediate portion of the bottom of the rear cover is slanted toward the water drain outlet.

17. The assembly of pipe hood and pipe unit for a ventilating fan according to claim 16, wherein the height of the water drain outlet is less than the distance between the bars of the grating.

18. The assembly of pipe hood and pipe unit for a ventilating fan according to claim 1, wherein the extended wall is of a semi-circular shape and is connected to the partition plate.

* * * * *